United States Patent [19]

Connolly

[11] 4,421,240

[45] Dec. 20, 1983

[54] GOLF CLUB DISPLAY RACK

[75] Inventor: John F. Connolly, Schaumburg, Ill.

[73] Assignee: Wittek Golf Range Supply Co., Ill.

[21] Appl. No.: 289,370

[22] Filed: Aug. 3, 1981

[51] Int. Cl.[3] ..... A47F 7/00

[52] U.S. Cl. ..... 211/60 G; 211/87

[58] Field of Search ..... 211/60 G, 60 R, 60 T, 211/63, 87; 248/224.1, 223.4

[56] References Cited

U.S. PATENT DOCUMENTS

| | | | |
|---|---|---|---|
| D. 129,390 | 9/1941 | Clouse | 211/60 G |
| 1,761,088 | 6/1930 | Pryde | 211/60 G UX |
| 2,480,597 | 8/1949 | Nelson | 211/60 G |
| 2,854,147 | 9/1958 | Derr | 211/60 R |
| 2,908,432 | 10/1959 | Kent | 211/60 R X |
| 3,003,734 | 10/1961 | Davis et al. | 248/223.4 X |
| 3,116,730 | 1/1964 | Tingley | 211/60 R X |
| 3,154,314 | 10/1964 | McCune | 211/606 |

FOREIGN PATENT DOCUMENTS

| | | | |
|---|---|---|---|
| 122329 | 1/1919 | United Kingdom | 248/224.1 |
| 1077792 | 8/1967 | United Kingdom | 248/224.1 |

*Primary Examiner*—Ramon S. Britts
*Assistant Examiner*—Robert W. Gibson, Jr.
*Attorney, Agent, or Firm*—Wm. A. Snow

[57] ABSTRACT

A four piece golf club display rack made entirely of molded plastic having a lower anchoring member to which a support is removably secured to support the wooden heads of golf clubs and grip portions of iron golf clubs and an upper supporting member removably secured to an upper anchoring member for supporting the heads of iron golf clubs and the grip portions of the wooden clubs.

1 Claim, 4 Drawing Figures

GOLF CLUB DISPLAY RACK

BACKGROUND OF THE INVENTION

Known golf club display racks are made of metal or wood and are permanently secured to the wall of a pro shop or a golf supply store and not removable, thereby creating an unsightly display stand when not displaying golf clubs. It was to overcome this inherent problem that the present invention was conceived.

SUMMARY OF THE INVENTION

A four piece display rack made entirely of molded plastic comprising a pair of anchoring members spaced apart vertically, the lower one being of larger size than the upper one, a large support member removably secured to the lower anchoring member for supporting the wooden heads of golf clubs and the free ends of the grip of the iron golf clubs, a smaller support member removably anchored to the smaller of the support members above the upper support member to support the grip portion of the wooden headed clubs and the portion of the iron clubs just below the heads thereof in suitable depressions.

DETAILED DESCRIPTION OF THE DRAWINGS

Figure 1:
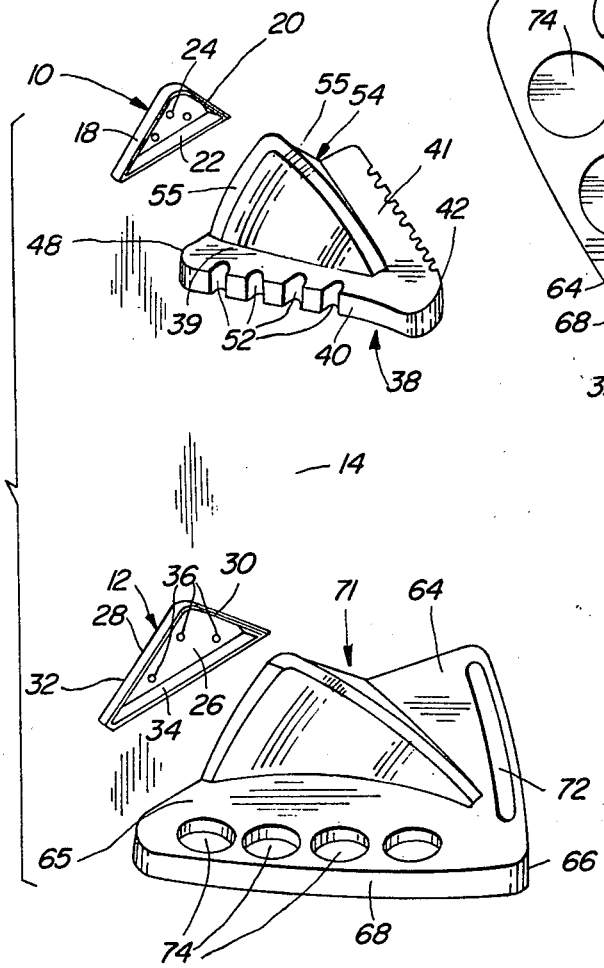
FIG. 1 is an exploded perspective view of the golf club display rack.

The device of the present invention comprises an upper and lower anchoring member 10, 12 of flat, substantially "V" configuration. The upper anchoring member 10 comprises a flat wall bearing surface 14 having an offset 16 around the angular sides thereof, terminating in outwardly extending side walls 18, 20. A bottom wall 22 is also inwardly extending and all are integrally formed in a mold. The wall bearing surface is provided with apertures 24 to receive screws 25 for fastening to a wall. It is to be noted that the side wall 20 is longer than the side wall 18.

The lower anchoring member 12 is identical to the upper member 10 but substantially larger in size but having the same configuration, i.e., wall bearing surface 26, offsets 28, side walls or flanges 30, 32, a short bottom wall or flange 34, all formed in one piece by molding. The surface 26 is provided with apertures 36.

The upper supporting member 38 is generally of "V" configuration but in the horizontal and all parts are integrally molded. This member comprises top walls 39, 41 and depending side walls or flanges 40, 42, and short rear walls or flanges 48, respectively. The rear walls 48 are similar in appearance to the rear walls 70 shown in FIG. 4. The side wall 42 and the adjacent top wall 41 are provided with nine U-shaped depressions 50 to receive a portion of the lower shaft ends of nine iron golf clubs with the club heads lying above the top wall 41. The side wall 40 is longer than the side wall 42. The side wall 42 and the adjacent top wall 39 are also provided with four U-shaped depressions 52 to receive a portion of the grips of four wooden headed golf clubs. The central portion of the top walls 39, 41 are provided with a bulbous portion 54 of substantially "V" configuration from the top edge 56 downwardly, sidewardly and forwardly to the top walls on a radius. The rear ends of the bulbous portion 54 are flat as at 55. Flanges 62 extend inwardly as at 61, 63 to seat snugly in the offsets 16 when the anchoring member is anchored to a wall, as shown in FIG. 3, to effectively support the member 54.

Figure 2:
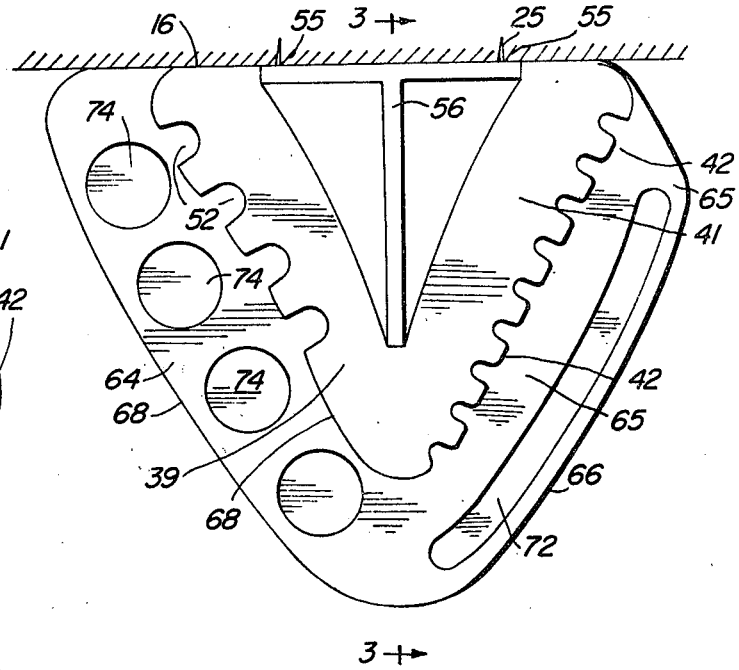
FIG. 2 is a top plan view of the lower supporting member.

The lower supporting member 67 is provided with top walls 64, 65, side walls or flanges 66, 68 and a rear wall or flange 70 (see FIG. 4) and central bulbous portion 71 which is identical to the bulbous portion 54 except it is of larger scale. The dash outline in FIG. 2 shows the bulbous portion 71 and if placed in full lines would make too much confusion in the drawing. The side wall 68 is longer than the side wall 66. The top wall 65 adjacent the side wall 66 is provided with a shallow, elongated, radial depression portion 72 to receive the top ends of the grip portions of the iron clubs. The top wall 64 adjacent the side wall 68 is provided with four shallow, circular depressions 74 to receive the sole of four wooden club heads and position the heads therein. The rear wall is provided with downwardly and inwardly extending flanges 78 to seat in the offset 28 to support the member 67 in position on the anchoring member 12 when the member 12 is anchored to a wall as shown in FIG. 3.

Figure 3:
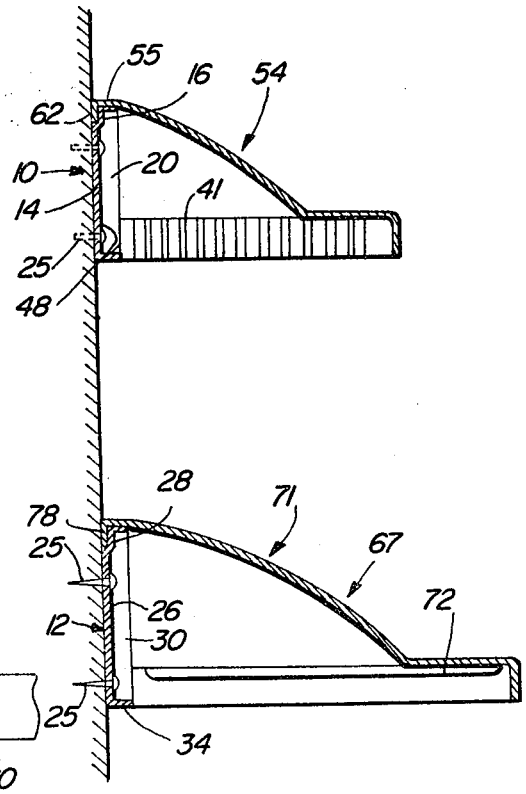
FIG. 3 is a cross-sectional view taken on the line 3—3 of FIG. 2.
Figure 4:
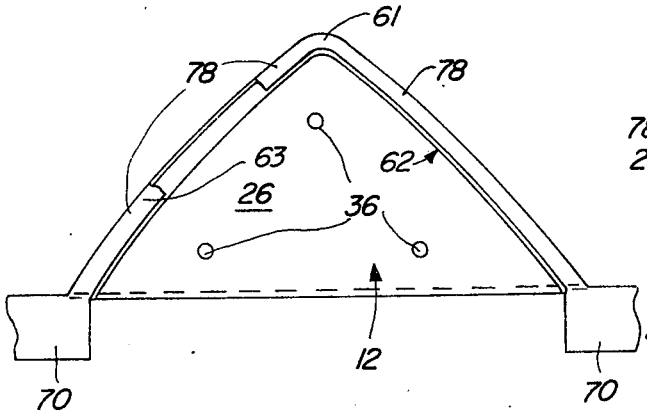
FIG. 4 is a plan view taken substantially on the line 4—4 of FIG. 3.

As shown in FIG. 3, the members 10, 12, 54 and 67 are all in vertical spaced alignment.

The side walls 40, 42, 66, 68 all have a radius while the rear walls or flanges are flat.

The rear walls or flanges 62 and 78 are each of a width to readily seat in the flanges 16 and 28, respectively, to readily support the supporting structures 54 and 67, respectively, to display golf clubs.

Although but one specific embodiment of this invention is herein shown and described, it will be understood that details of the construction shown may be altered or omitted without departing from the spirit of the invention as defined by the following claim.

I claim:

1. A display rack for a set of golf clubs comprising:

(a) a pair of substantially V-shaped mounting means, each of said means including a rear flat wall and inwardly-extending side and bottom walls, and an offset on said rear wall adjacent said side walls, one of said mounting means being larger than the other in area, (b) a substantially horizontally-extending, V-shaped supporting structure having a top wall and side flanges, a bulbous portion extending inwardly from said top wall and medially of said side flanges, of substantially inverted V-shape having a substantially inverted V-shaped rear flange extending inwardly, said bulbous portion tapering on a radius from the rear flange forwardly and sidewardly in both directions to said top wall, a series of spaced, inwardly-extending depressions in said top wall adjacent one side of said bulbous portion to seat the grips of wooden golf clubs, a series of spaced, inwardly-extending depressions on the other side wall adjacent said bulbous portion in said top wall to receive the ends of the shank adjacent iron golf club heads to support the iron club heads above said depressions, (c) a second substantially horizontally-extending, V-shaped supporting member larger than said first mentioned member having top walls with depending side walls, a bulbous portion extending upwardly from said top walls medially of said side walls, the rear end of said bulbous portion being substantially flat and of substantially inverted V-shaped and having downwardly and inwardly-extending flanges, said bulbous portion tapering radially on a radius from said rear flanges forwardly and sidewardly in both directions to said top walls, one of said top walls having a series of spaced, cylindrical depressions in said top wall to support the sole of wooden golf clubs, a radially-disposed depression in the other of said top walls to support the ends of the grips of iron golf clubs, whereby, when said mounting means are anchored to a vertical surface in vertical spaced relationship, the substantially inverted V-shaped flanges on the rear of said bulbous portions of said supporting means will each be removably secured one in each of the offset portions in said mounting means to display golf clubs.

* * * * *